US006786740B2

(12) United States Patent
Ito

(10) Patent No.: US 6,786,740 B2
(45) Date of Patent: Sep. 7, 2004

(54) JOINING STRUCTURE FOR JUNCTION BOX AND ELECTRICAL COMPONENT CONNECTOR BLOCK

(75) Inventor: Katsuya Ito, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/423,626

(22) Filed: Apr. 28, 2003

(65) Prior Publication Data

US 2003/0211760 A1 Nov. 13, 2003

(30) Foreign Application Priority Data

May 10, 2002 (JP) ..... 2002-135298

(51) Int. Cl.[7] ..... H01R 12/00
(52) U.S. Cl. ..... 439/76.2
(58) Field of Search ..... 439/76.2, 949, 439/701

(56) References Cited

U.S. PATENT DOCUMENTS

| | | | | |
|---|---|---|---|---|
| 4,580,861 A | | 4/1986 | Kaley | 439/594 |
| 4,649,230 A | | 3/1987 | Nielsen | 174/65 R |
| 5,295,870 A | | 3/1994 | Rei et al. | 439/717 |
| 5,507,077 A | | 4/1996 | Kotajima | 24/669 |
| 5,702,021 A | | 12/1997 | Ito | 220/326 |
| 5,834,692 A | | 11/1998 | Lentz | 174/57 |
| 5,837,938 A | | 11/1998 | Sakamoto | 174/66 |
| 5,839,594 A | | 11/1998 | Barbour | 220/3.7 |
| 5,868,583 A | * | 2/1999 | Naitou et al. | 439/76.2 |
| 5,897,385 A | | 4/1999 | Kasai | 439/76.2 |
| 5,915,978 A | * | 6/1999 | Hayakawa et al. | 439/76.2 |
| 6,022,247 A | * | 2/2000 | Akiyama et al. | 439/701 |
| 6,196,882 B1 | * | 3/2001 | Sato et al. | 439/701 |
| 6,413,118 B2 | | 7/2002 | Fukatsu | 439/542 |
| 2003/0109150 A1 | | 6/2003 | Saka et al. | 439/76.2 |

FOREIGN PATENT DOCUMENTS

| | | | | |
|---|---|---|---|---|
| FR | 2 742 004 | * | 6/1997 | H01R/13/506 |
| JP | 10108337 | | 4/1998 | |
| JP | 2000-12168 | | 1/2000 | |

* cited by examiner

*Primary Examiner*—Tulsidas C. Patel
(74) *Attorney, Agent, or Firm*—Greenblum & Bernstein, P.L.C.

(57) ABSTRACT

A connecting structure between a junction box and an electrical component connector block that prevents material failure of the connecting structure. The junction box and connector block, which includes receptacles for components on an upper surface thereof, are adjacently connected by joint structure formed between mutually facing external sidewalls of the junction box and connector block. A hook portion, which is formed as an integral component of the connector block, connects to the upper edge of a sidewall of junction box when the connector block is joined to the junction box. This structure prevents the load applied by the insertion of components into a receptacle of the connector block from being concentrated at a single point, and thus prevents material failure of the connecting structure.

10 Claims, 8 Drawing Sheets

JOINING STRUCTURE FOR JUNCTION BOX AND ELECTRICAL COMPONENT CONNECTOR BLOCK

BACKGROUND OF THE INVENTION

1. Field of the Invention

The invention relates to a structure that joins a junction box and an electrical component connector block. The structure is configured so as to prevent material failure of the components that make up the connecting structure.

2. Description of the Related Art

Modern automobiles incorporate an increasing number of electrical components, which has resulted in an increase in the size of junction boxes used to connect electrical power and signal circuits, and increasingly complex junction box structures. As a result of this tendency toward larger and more complex junction boxes, and the requirement that junction boxes be capable of flexibly adapting to changes in the layout of circuits connected thereto, connecting structure must be provided to connect relay blocks, fuse blocks, and similar components to the junction box.

FIGS. 8A and 8B illustrate a conventional connecting structure for joining a junction box 1 and a relay block 4. In this structure, relay block 4 is joined to a junction box frame 2 through an insertion portion 5 located on an external sidewall 4*b* of relay block 4, and a receiver bracket 3 located on an external sidewall 2*a* of junction box frame 2. Relay block 4 is attached to junction box frame 2 by aligning insertion portion 5 over receiver bracket 3 and sliding relay block 4 downward. Attachment is complete when insertion portion 5 slides downward to a fully inserted position within receiver bracket 3, such that relay block 4 is aligned adjacent to junction box 1. A relay 4*a* can then be inserted into the upper surface of the attached relay block 4.

With relay block 4 attached to the junction box 1 in an adjacently aligned position, the force required to insert relay 4*a* into the relay block is applied as a leveraged load to receiver bracket 3 and insertion portion 5. As shown in FIG. 8C, external sidewall 2*a* of receiver bracket 3 is prone to material failure when a load greater than that required for insertion of the relay 4*a* is applied to the connecting components. If frame 2 of the junction box 1 is made from a glass impregnated resin, the connecting structure may fail more easily as a result of a load concentrated at a single point. The leverage force becomes more pronounced and the potential for material failure increases when multiple rows of relays 4*a* are installed onto the relay block 4, particularly during insertion of the outer row of relays 4*a*. Moreover, this type of failure may not only result from the insertion of relays 4*a*, but also from other objects striking or applying force to the relay block 4.

SUMMARY OF THE INVENTION

The present invention has been made in view of the above-described problems. Accordingly, it is an object of the present invention to provide a structure for joining an electrical component connector block, such as a relay block, fuse block, or similar component, to a junction box in adjacent alignment, wherein the connecting structure is not prone to material failure.

According to one aspect of the present invention, there is provided a connecting structure for adjacently joining a junction box and an electrical connector block, the connector block including a component receptacle portion on an upper surface thereof. The connecting structure includes connecting components provided on a sidewall of the junction box and a sidewall of the connector block, and a protruding hook portion provided on the connector block. The hook portion is configured to connect to an upper edge of the junction box sidewall. The protruding hook portion may be provided on the sidewall of the connector block.

According to a further aspect of the present invention, the hook portion distributes a force resulting from insertion of a component into the component receptacle portion of the connector block along the upper edge of the junction box sidewall.

Because the connecting structure forms a joint where the hook portion of the connector block engages a sidewall of the junction box, the force applied while pressing a component into the component receptacle portion is not concentrated on the connecting structure, but is instead distributed through the sidewall by the hook portion. As a result, the tendency for the connecting structure between the junction box and electrical connector block to materially fail is significantly reduced.

According to a further aspect of the present invention, the connecting components include a receiver bracket provided on the junction box sidewall and an insertion bracket provided on the connector block sidewall. The insertion bracket moves downward into the receiver bracket while the hook portion simultaneously moves downward to connect to the upper edge of the junction box sidewall. The receiver bracket may further include a lock latch and the insertion bracket may further include a lock tab configured to engage the lock latch for locking the connector block and the junction box in a connected condition. The attachment of the hook portion to the sidewall of the junction box occurs during joining of the electrical connector block and the junction box, providing an efficient attachment operation.

According to a further aspect of the present invention, the junction box sidewall includes first and second parallel sidewall portions having a space therebetween. The hook portion includes first and second hooks configured to connect to respective upper edges of the first and second parallel sidewall portions. This type of structure is able to further prevent material failure of the connecting structure by distributing the component insertion force to the first and second sidewall portions through the first and second hooks.

The connector block may be a relay block, and the component receptacle portion of the connector block may be configured to receive at least one relay inserted therein. The connector block may be a fuse block, and the component receptacle portion of the connector block may be configured to receive at least one fuse inserted therein.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
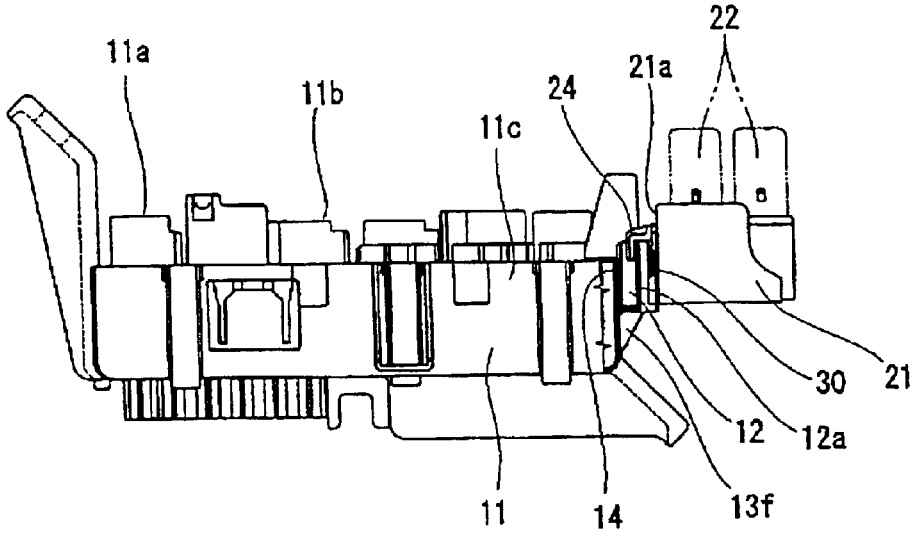
FIG. 1 is a partial cross sectional side view showing joining structure for a junction box and electrical component connector block according to a first embodiment of the invention.

Embodiments of the present invention will be described below with reference to the drawings. FIGS. 1 through 6 illustrate a first embodiment of the invention in the form of a connecting structure that joins a relay block 21 to a junction box 11. FIG. 1 illustrates the connecting structure between junction box 11, to which an automotive wire harness may be attached, and an electrical component connector block in the form of relay block 21.

The junction box 11 may be formed as a box-type structure made of any suitable material, such as a glass impregnated resin. Junction box 11 includes a connector 11*a* to which a wire harness connector may be attached, a component connector 11*b* to which various electrical components may be installed, and a bus bar (not shown) which is configured to connect circuits within the junction box. A pocket 12 extends outward from a specific location on a perimeter wall 11*c* of junction box 11 and forms a space for the connection of relay block 21. A receiver bracket 13 forms one side of joint portion 30 that fixedly attaches relay block 21 to an external surface of a sidewall 12*a* of pocket 12. Insertion bracket 23 located on the relay block 21 forms the other side of joint portion 30.

Figure 2:
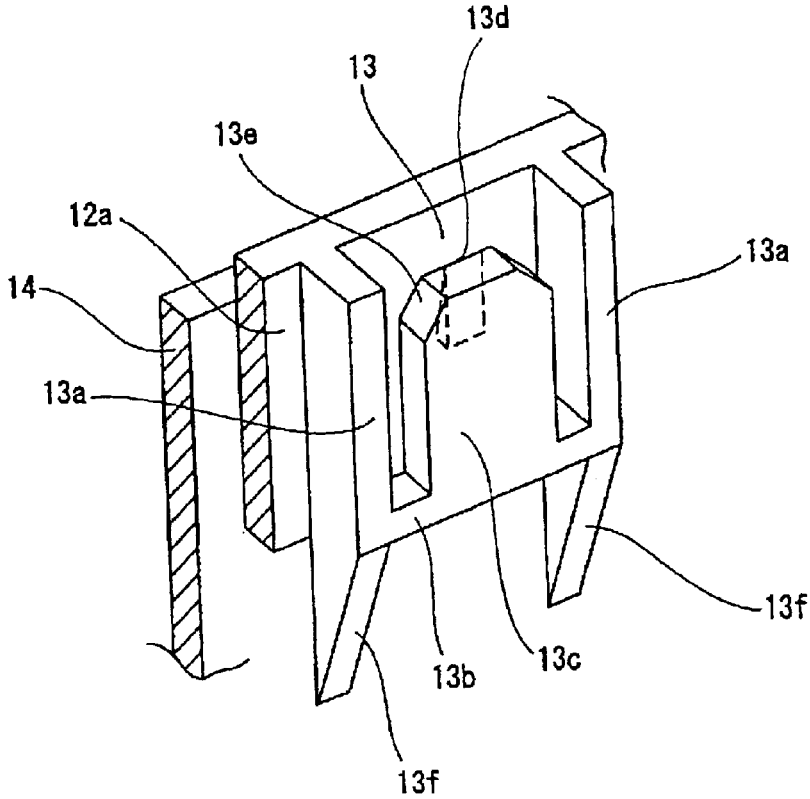
FIG. 2 is an enlarged perspective view of a receiver bracket portion of the junction box of FIG. 1.
Figure 3A:
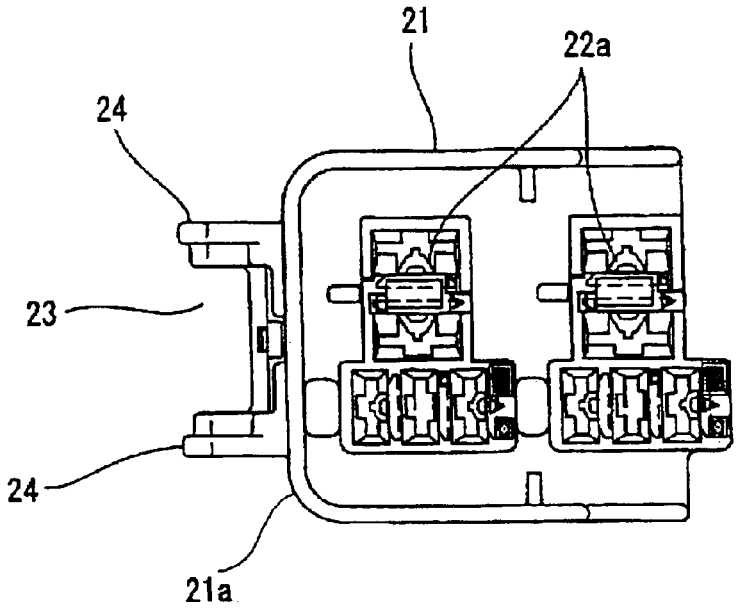
FIG. 3A is a plan view of the relay block of FIG. 1.
Figure 3B:
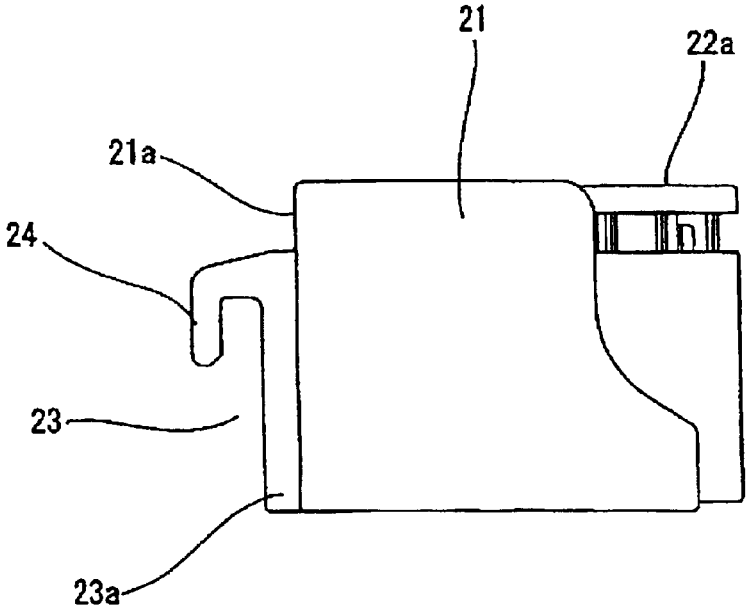
FIG. 3B is a side view of the relay block of FIG. 1.

As shown in FIG. 2, receiver bracket 13 includes a pair of vertically oriented guide ribs 13*a* that extend downward on the external surface of sidewall 12*a,* and are spaced from each other at a distance corresponding to the width of insertion bracket 23. A stop base 13*b* is provided between the lower ends of guide ribs 13*a*. The stop base 13*b* connects guide ribs 13*a* and positions insertion bracket 23 of relay block 21 within receiver bracket 13 by providing a contact surface for the lower end of insertion bracket 23. A flexible tongue 13*c* is provided on a center portion of stop base 13*b,* extending upward between guide ribs 13*a,* and is configured so as to provide spaces between tongue 13*c* and guide ribs 13*a*. The inner surface of a top portion of tongue 13*c* includes a lock latch 13*d* that inclines upward and inward to the top edge of tongue 13*c*. Chamfered surfaces 13*e* are formed on the upper corners of tongue 13*c* for aiding the insertion of insertion bracket 23. Reinforcing ribs 13*f* extend downward from the lower portion of stop base 13*b* between receiver bracket 13 and perimeter wall 11*c* for further supporting stop base 13*b*. Moreover, pocket 12 of junction box 11 includes an internal sidewall 14, which is internal to, spaced from and parallel with sidewall 12*a,* with the top of internal sidewall 14 being located below the top of sidewall 12*a*.

As shown in FIGS. 3A through 4B, relay block 21 may be formed as a box-like structure made of any suitable material, such as a synthetic resin. In this embodiment, the upper portion of relay block 21 is provided with two adjacently aligned relay receptacles 22*a* into which relays 22 may be inserted. Insertion bracket 23 is provided on an external surface of a sidewall 21*a* of relay block 21 as a structure for attachment to receiver bracket 13 on junction box 11.

Figure 4A:
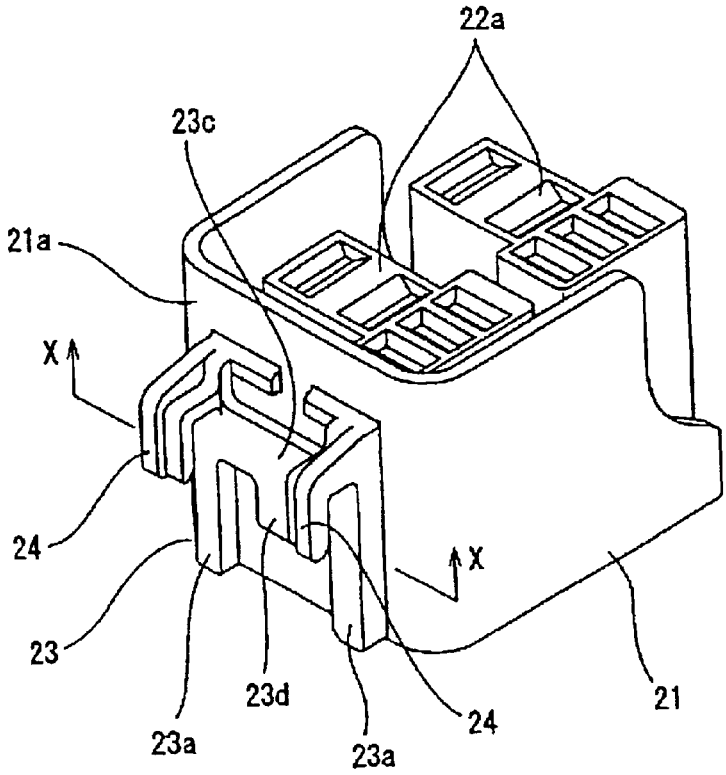
FIG. 4A is a perspective view of the relay block of FIG. 1.
Figure 4B:
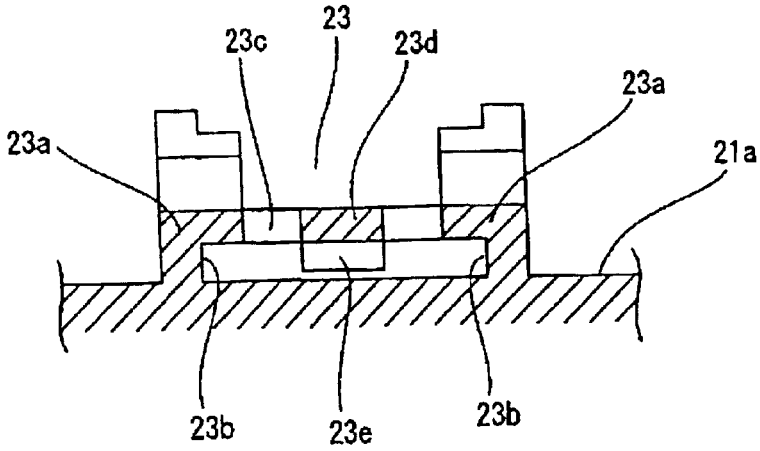
FIG. 4B is a cross sectional view taken along line X—X of FIG. 4A.

As shown in FIG. 4A, insertion bracket 23 includes two protruding guide rails 23*a* that are configured to slide into the space between guide ribs 13*a*. As shown in FIG. 4B, a guide channel 23*b* is formed between the opposed inner surfaces of guide rails 23*a* to provide space for the entry of tongue 13*c* between guide rails 23*a*. Moreover, a flange 23*c* having the same width as guide channel 23*b* is provided between the upper ends of guide rails 23*a*. A flexible finger 23*d* extends downward from a central portion of flange 23*c*. A lock tab 23*e,* is formed as a protruding portion extending from the inner surface of finger 23*d* for engaging and connecting to lock latch 13*d* of junction box 11. Lock tab 23*e* is positioned so as to lock against lock latch 13*d* when insertion bracket 23 of relay block 21 is inserted into receiver bracket 13 of junction box 11 to a point at which the lower end of guide rails 23*a* contacts with stop base 13*b*.

A pair of inverted L-shaped hook portions 24 are provided at the upper portion of guide rails 23*a* of relay block 21, and extend outwardly from sidewall 21*a* such that their top portions are configured to hook over and connect with the upper edge of sidewall 12*a* of junction box 11. The hook portions 24 are preferably formed unitarily and in one piece with the relay block 21. Hooks portions 24 connect to the top edge of sidewall 12*a* when insertion bracket 23 enters receiver bracket 13, and are configured to straddle portions of sidewall 12*a* between guide rails 23*a*.

Figure 5A:
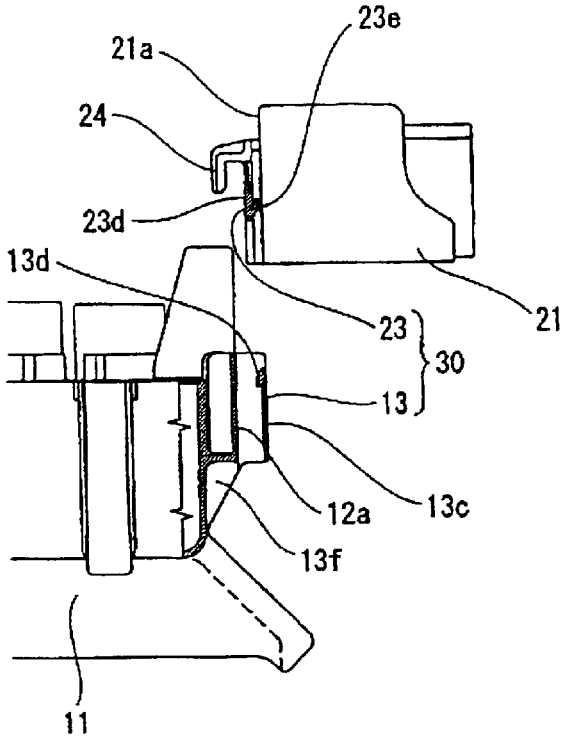
FIGS. 5A and 5B are enlarged partial cross sectional side views illustrating the process through which the relay block is attached to the junction box of FIG. 1.
Figure 5B:
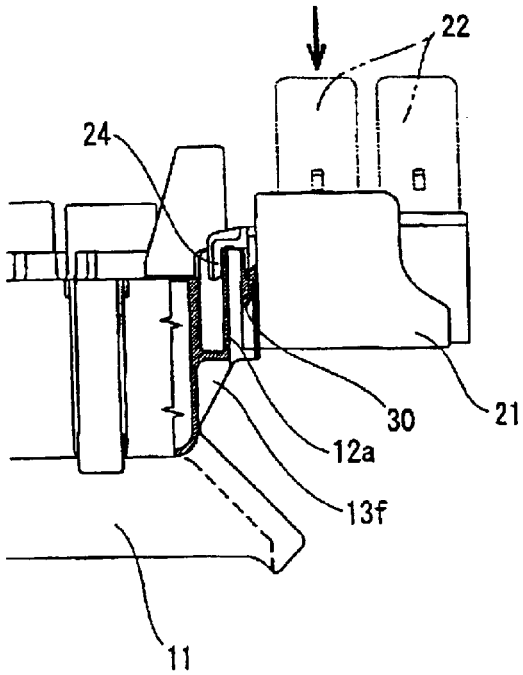
Figure 6:
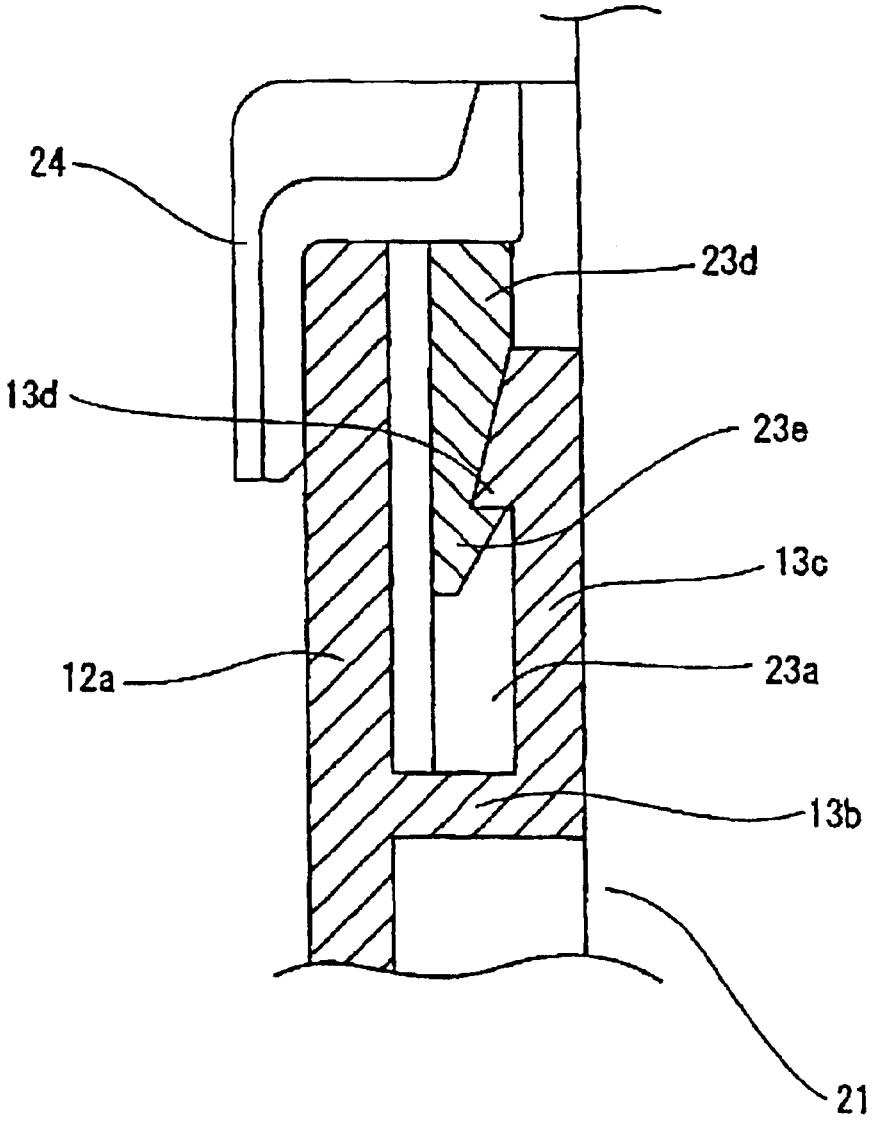
FIG. 6 is an enlarged cross sectional view of the connecting structure between the junction box and relay block of FIG. 1.

The following will describe the operation through which the respective connecting structures of the first embodiment are joined. As shown in FIG. 5A, in order to connect relay block 21 to junction box 11, relay block 21 is first positioned such that insertion bracket 23 is located above and aligned with receiver bracket 13. The relay block 21 is moved downward to insert the external lateral faces of guide rails 23*a* of insertion bracket 23 into the internal space between guide ribs 13*a* of receiver bracket 13. Tongue 13*c* slides into guide channel 23*b* and finger 23*d* slides into the space between tongue 13*c* and sidewall 12*a*. At the same time, hook portions 24 pass over and connect to the upper edge of sidewall 12*a* of junction box 11. Moving relay block 21 still further downward causes lock latch 13*d* on tongue 13*c* to press against lock tab 23*e* on finger 23*d*. The flexibility of the tongue 13*c* and finger 23*d* permits their mutual displacement allowing lock tab 23*e* to ride over and lock against lock latch 13*d* as illustrated in FIGS. 5B and 6. In this condition, the lower edges of guide rails 23*a* contact with stop base 13*b* while hook portions 24 connect to the upper edge of sidewall 12*a,* thus joining relay block 21 to junction box 11 in an adjacently aligned position.

With relay block 21 installed onto junction box 11, a relay 22 may be pushed into a relay receptacle 22*a* from above. The insertion load applied to relay block 21 during the insertion of relay 22 would normally be leveraged in a concentrated manner against tongue 13*c* and finger 23*d.* However, the structure of the first embodiment prevents damage to the receiver bracket 13 and insertion bracket 23 by distributing the relay insertion load through the joint connection formed by hook portions 24 straddling sidewall 12*a.*

Figure 7A:
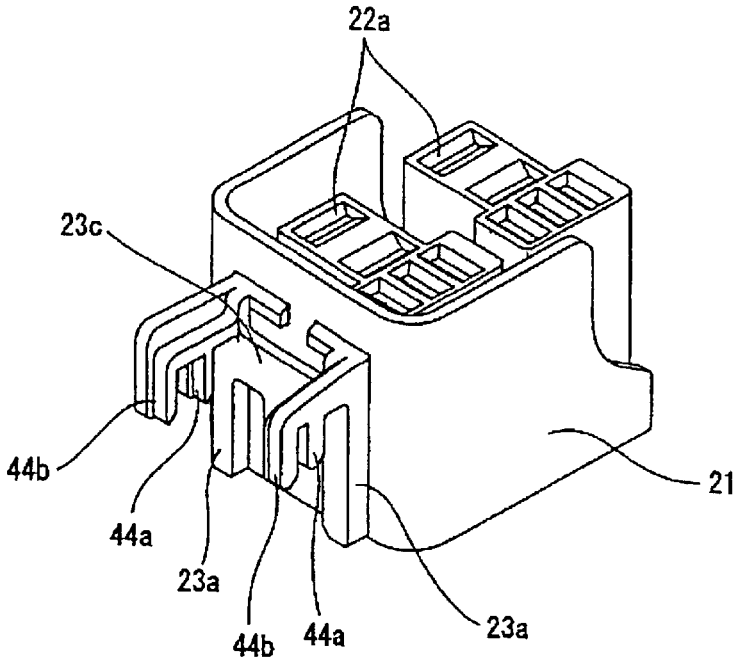
FIG. 7A is a perspective view of a relay block according to a second embodiment of the invention.
Figure 7B:
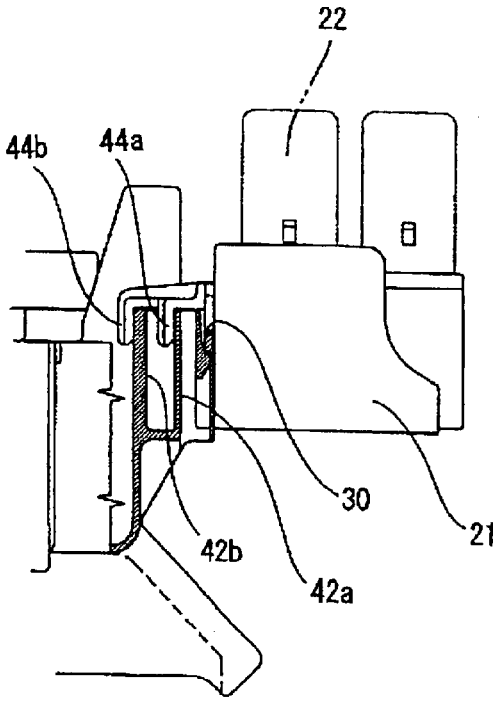
FIG. 7B is an enlarged partial sectional side view of the structure connecting the junction box and relay block according to the second embodiment of the invention.
Figure 8A:
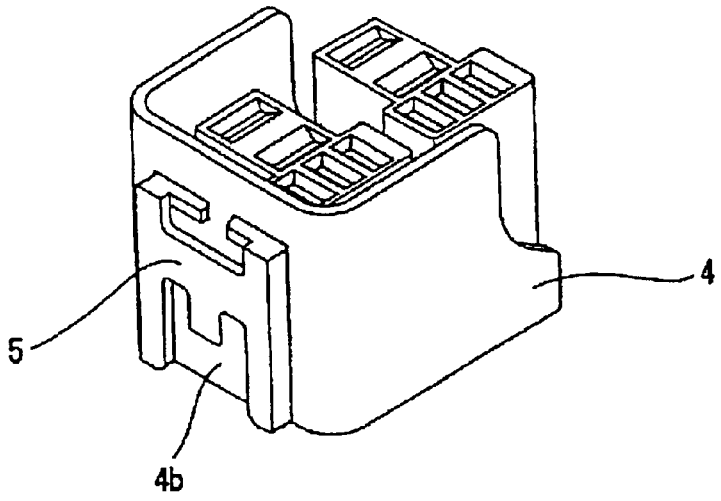
FIG. 8A PRIOR ART
FIG. 8A is a perspective view.
Figure 8B:
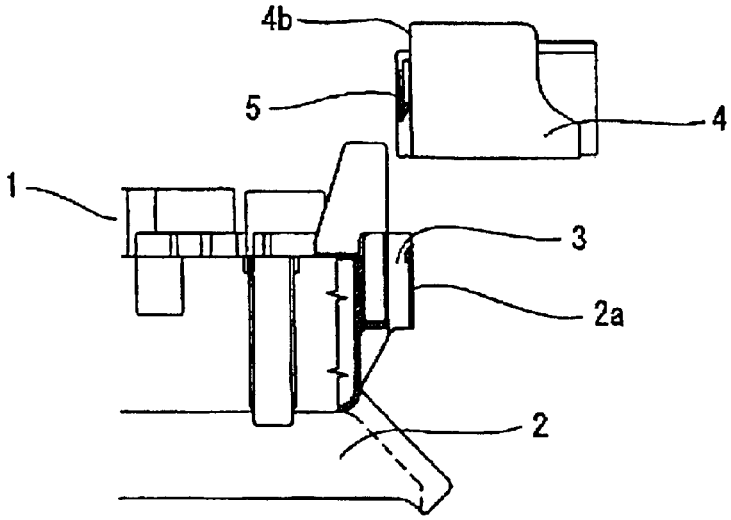
FIG. 8B PRIOR ART
FIGS. 8B and 8C are partial cross sectional side views, showing a conventional connecting structure for joining a junction box and a relay block.
Figure 8C:
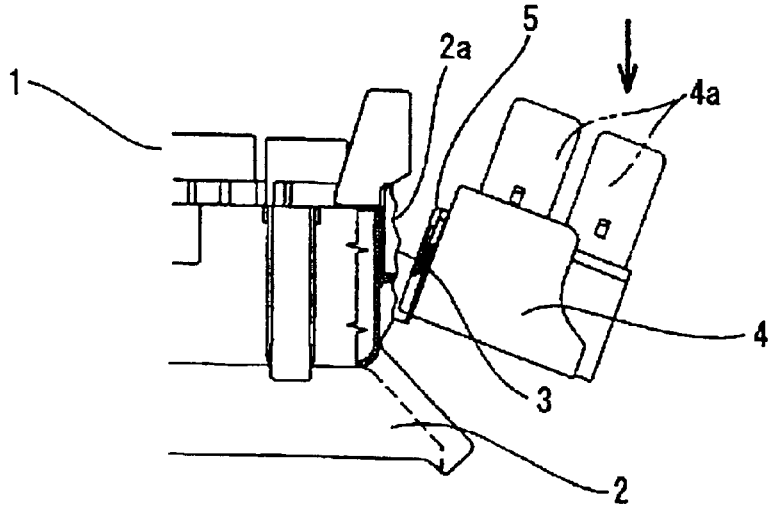
FIG. 8C PRIOR ART

FIGS. 7A and 7B show a second embodiment of the structure for connecting a junction box and electrical component connector block. In the second embodiment, a first sidewall 42*a* and a second sidewall 42*b* are provided on junction box 11. First hook portions 44*a* and second hook portions 44*b* are provided on the side of relay block 21, located opposite to first sidewall 42*a* and second sidewall 42*b,* and are configured for respective connection thereto. Other structures of the second embodiment are essentially the same as those of the first embodiment, and therefore their descriptions have been omitted here.

In the second embodiment, the load generated by the insertion of relays 22 into relay block 21 is distributed to an even greater degree as a result of first hook portions 44*a* and second hook portions 44*b* respectively engaging and connecting to the top edges of first sidewall 42*a* and second sidewall 42*b.* As a result, the joint formed between junction box 11 and relay block 21 exhibits even greater strength.

While the embodiments have described the electrical component connector block as a relay block 21, the invention also includes joint structure for connecting a fuse block, a combined fuse and relay block, or similar components, to a junction box 11. Also, while the embodiments have described relay block 21 as containing two rows of receptacles 22*a,* relay block 21 may contain any number of receptacles. Further, as the leveraging load increases in proportion to the number of receptacles contained in the relay block, the connecting structure should be strengthened accordingly. In this regard, additional hook portions may be provided. Further, the present invention also includes embodiments in which hook portions are provided on a junction box for engaging and connecting to a sidewall of a connector block.

The connecting structure of the invention joins the junction box and electrical connector block in mutual adjacent alignment that prevents a load applied from the top of the connector block from being concentrated at a single point on the connecting structure. In other words, the problem of material failure of the connecting structure is eliminated as a result of hook portions distributing and dispersing the load along the sidewall of the junction box.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Patent Application No. 2002-135298 filed on May 10, 2002, which is herein expressly incorporated by reference in its entirety.

What is claimed:

1. A connecting structure for adjacently joining a junction box and an electrical connector block, said connector block including a component receptacle portion on an upper surface thereof, said connecting structure comprising:

connecting components provided on a sidewall of said junction box and a sidewall of said connector block; and a protruding hook portion provided on said connector block, said hook portion being configured to connect to an upper edge of said junction box sidewall.

2. The connecting structure according to claim 1, said connecting components comprising:

a receiver bracket provided on said junction box sidewall; and an insertion bracket provided on said connector block sidewall, wherein said insertion bracket moves downward into said receiver bracket while said hook portion simultaneously moves downward to connect to the upper edge of said junction box sidewall.

3. The connecting structure according to claim 2, wherein said junction box sidewall includes first and second parallel sidewall portions having a space therebetween, and said hook portion includes first and second hooks configured to connect to respective upper edges of said first and second parallel sidewall portions.

4. The connecting structure according to claim 2, wherein said hook portion distributes a force resulting from insertion of a component into the component receptacle portion of said connector block along the upper edge of said junction box sidewall.

5. The connecting structure according to claim 2, wherein said receiver bracket includes a lock latch and said insertion bracket includes a lock tab configured to engage said lock latch for locking said connector block and said junction box in a connected condition.

6. The connecting structure according to claim 1, wherein said junction box sidewall includes first and second parallel sidewall portions having a space therebetween, and said hook portion includes first and second hooks configured to connect to respective upper edges of said first and second parallel sidewall portions.

7. The connecting structure according to claim 1, wherein said hook portion distributes a force resulting from insertion of a component into the component receptacle portion of said connector block along the upper edge of said junction box sidewall.

8. The connecting structure according to claim 1, wherein said connector block comprises a relay block, and the component receptacle portion of said connector block is configured to receive at least one relay inserted therein.

9. The connecting structure according to claim 1, wherein said connector block comprises a fuse block, and the component receptacle portion of said connector block is configured to receive at least one fuse inserted therein.

10. The connecting structure according to claim 1, wherein said protruding hook portion is provided on said sidewall of said connector block.

* * * * *